United States Patent [19]

Brif et al.

[11] 4,239,713

[45] Dec. 16, 1980

[54] METHOD AND MACHINE FOR EXPANDING TUBES IN A TUBE WALL

[76] Inventors: Viktor M. Brif; Leonid M. Brif, both of ulitsa Dvinskaya, 14, kv. 14., Volograd, U.S.S.R.

[21] Appl. No.: 918,825

[22] Filed: Jun. 22, 1978

[51] Int. Cl.[3] ..... B21D 39/06; B29C 27/12

[52] U.S. Cl. ..... 264/40.1; 29/157.3 R; 29/523; 165/173; 264/40.5; 264/248; 264/269; 264/310; 285/382.4

[58] Field of Search ..... 264/40.1, 248, 310, 264/269, 280, 40.5; 425/140, 150, 163, 172; 29/523, 157.3 R; 285/382.4; 165/173

[56] References Cited

U.S. PATENT DOCUMENTS

| | | | |
|---|---|---|---|
| 2,735,698 | 2/1956 | Brinen | 29/523 |
| 3,205,289 | 9/1965 | Carpenter | 264/280 |
| 3,220,602 | 11/1965 | Ficker | 29/523 |
| 3,467,180 | 9/1969 | Pensotti | 29/523 |
| 3,991,150 | 11/1976 | De Putter | 264/310 |

FOREIGN PATENT DOCUMENTS

| | | |
|---|---|---|
| 2205281 | 8/1973 | Fed. Rep. of Germany . |
| 2622753 | 12/1977 | Fed. Rep. of Germany . |
| 428234 | 4/1975 | U.S.S.R. . |

*Primary Examiner*—Jeffery R. Thurlow

*Attorney, Agent, or Firm*—Haseltine, Lake & Waters

[57] ABSTRACT

A method of assembling tubular heat exchangers and particularly of expanding tubes in the tube walls of various heat exchangers and steam generators in the petrochemical, gas-processing, chemical, power, metallurgical and shipbuilding industries including the manufacture of nuclear power plants for ships, of nuclear power stations and related products. According to the method the measuring of a force parameter or variable is effected simultaneously with the measuring of a linear parameter or variable of the expanding successively at three areas, viz. the area of elastic deformation of the tube, the area of plastic deformation of the tube up to the engagement of the tube with the surface of the opening in the tube wall, and the area of elastic deformation of the tube wall.

6 Claims, 4 Drawing Figures

METHOD AND MACHINE FOR EXPANDING TUBES IN A TUBE WALL

FIELD OF THE INVENTION

The invention relates to the technique of assembling heat exchangers and can be utilized at expanding tubes in the tube walls of heat exchanging apparatus and steam generators used in the petrochemical, gas-processing, chemical, power, metallurgical and shipbuilding industries, including the manufacture of nuclear power plants for ships, of nuclear power stations and related products.

The present invention can be utilized to utmost effectiveness in the manufacture of heat exchangers and heat generators rated for operation at elevated pressures and temperatures, when the sealing properties of the rolling joints have to satisfy particularly strict requirements put forward by either the explosion or environment pollution hazards.

However, the use of the present invention at expanding the tubes of commonly employed heat exchangers likewise prolongs the downtime-free service life of the plant.

Background of the Invention

Known in the art is a method of expanding tubes in a tube wall by acting thereupon with a roller-type rolling tool and controlling a preselected varying effort associated with the expanding, e.g. the torque applied to the tool.

The method has a disadvantage resulting from the varying effort of the expanding of a tube being preselected and taken to be the same for all the tubes of a given heat exchanger or a group of heat exchangers with similar sizes and types of the tubes and of the tube walls, without provision for individual properties of each rolling joint, which, however, have been found to vary within a significant range.

Consequently, the preselected effort is to be determined, in order to preclude "overrolling", for tubes with the most undesirable spread of mechanical properties and dimensions (the minimum yield point, the minimum tube wall thickness, etc.).

Known in the art are expanding machines capable of performing the abovedescribed known method, such as the expanding machine marketed by Ferrometal in the FRG, comprising a roller-type rolling tool associated with a drive and a device for measuring the torque applied to the tool, by the current consumed by the electric motor of the drive, and also a unit controlling this drive and terminating the expanding operation upon the value of the torque, i.e. of the current, having attained the predetermined magnitude.

By this method of expanding it is possible to ensure the maximum full strength and fluid-tightness of the rolling joint merely for a share of the total bulk of tubes, about 1 to 2 percent. The rest of the tubes have their potential load-bearing capacity underemployed, which results in inadequate reliability of rolling joints, production losses on account of downtime of the heat exchangers, and sometimes even to fires, explosions, and environment pollution.

Summary of the Invention

It is an object of the invention to provide a method and a machine for expanding tubes in a tube wall, which will utilize to the utmost the potential load-bearing capacity of the elements of the rolling joint.

It is an important object of the present invention to provide a method and a machine for expanding tubes in a tube wall, which will significantly enhance the strength and fluid-tightness of the rolling joint.

It is still another object of the present invention to improve the operability of heat exchangers and steam generators incorporating tubes expanded with the employment of the herein disclosed method.

These and other objects are attained in a method of expanding a tube in a tube wall by acting thereupon with a roller-type rolling tool and controlling the expanding operation by a variable expanding effort applied to the tool, in which method, in accordance with the present invention, the measurement of the variable effort is effected simultaneously with the measurement of a linear variable of the expanding operation successively over three areas, viz. the area of elastic deformation of the tube, the area of plastic deformation of the tube until the external surface thereof engages the surface of the opening in the tube wall and the area of elastic deformation of the tube wall, so as to optimize the control of the expanding process by either the variable effort or the linear variable, in accordance with the geometric dimensions and mechanical properties of the tube and of the tube wall.

An expanding machine capable of performing the above method comprises a roller-type rolling tool associated with a drive and a device for measuring the variable effort applied to the tool, and a control unit of the drive, said machine, in accordance with the present invention, being provided intermediate the tool and the drive with a device for measuring the linear variables of the expanding, said devices for measuring the variable effort and linear variables being operatively connected with the input of a computing device of output is connected through the control unit with the drive, to deenergize and reverse the latter when the variable effort reaches an optimum value as determined by the computing device by corresponding processing of the data obtained by the measurement of the varying effort and the linear variables during the expanding process.

The disclosed method and the machine for performing the method enable, in the course of the operation, of expanding each successive joint to determine either such a maximum effort or such a linear variable value which fully provides for the actual dimensions and the mechanical properties of the elements of this particular joint, thus ensuring the maximum utilization of their load-bearing capacity. Thereby, the strength and fluid tightness of each rolling joint are significantly enhanced, which prolongs the downtime-free service life of a heat exchanger or a steam generator.

Given below is a description of an embodiment of the invention with reference to the accompanying drawings.

Detailed Description

Figure 1:
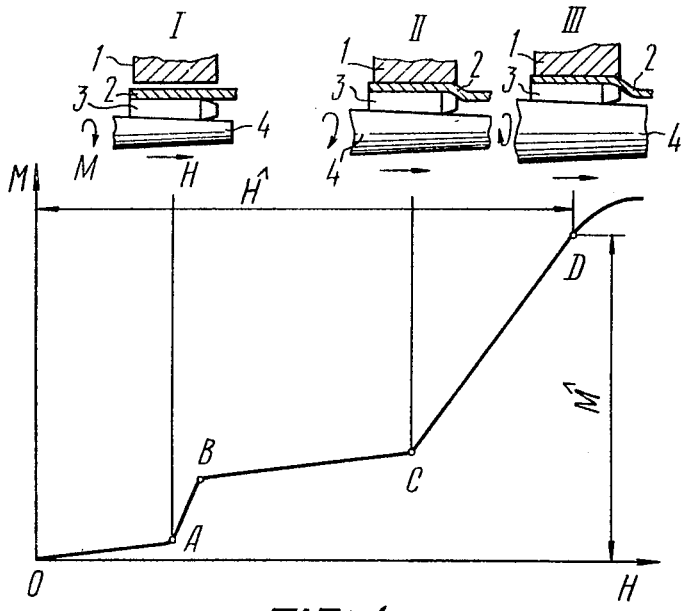
FIG. 1 is a schematic illustration of the process of expanding a tube in a tube wall as plotted in the form of an "axial displacement of the spindle vs. torque value" graph and also showing the relative positions of the expanding tool, the tube and the tube wall at characteristic points of the expanding process.

The upper portion of FIG. 1 of the appended drawings shows successive relative positions of the elements of a rolling joint of a tube wall or lattice 1 and a tube 2, jointly with those of the elements of the expanding tool, viz. rollers 3 and a tapered mandrel 4, in the course of an expanding operation. Position I of the drawing is the initial stage whereat a certain clearance is present between the tube 2 and the tube wall 1 at the moment of introducing the tapered mandrel 4 with the rollers 3 into the tube 2, into engagement with its internal surface. Position II is that of the moment of engagement of the tube 2 with the tube wall 1, resulting from a corresponding feed of the tapered mandrel 4 in the axial direction. Position III is that of conjoint deformation of the tube 2 and of the tube wall 1. The lower portion of FIG. 1 shows schematically the expanding process as plotted by axial displacement of the mandrel (X-axis) vs. torque applied to the tool (Y-axis). The portion OA of the graph corresponds to elastic bending of the rollers (in cases when the rollers are at an angle to the longitudinal axis of the mandrel). The portion AB corresponds to elastic deformation of the tube 2, and the portion BC—to its plastic deformation. The point C corresponds to the moment of engagement of the tube 2 with the tube wall 1, whereafter (along the portion CD) there takes place conjoint deformation of the tube 2 and of the tube wall 1. Corresponding mathematical processing of the outcome of the measurement of the linear variable and the effort variable, i.e. of the axial displacement of the mandrel and of the torque, obtained at the abovementioned portions, successively, enables determining for a given rolling joint the optimum, value $M_t$ from the viewpoint of ensuring its maximum strength and fluid tightness, of the variable effort, or else of the linear displacement $H_{ax}$, defining the position of the point D in FIG. 1.

When the point D is reached in operation, the expanding process is terminated, and the expanding tool is retracted from the tube, e.g. by reversal of the drive.

Figure 2:
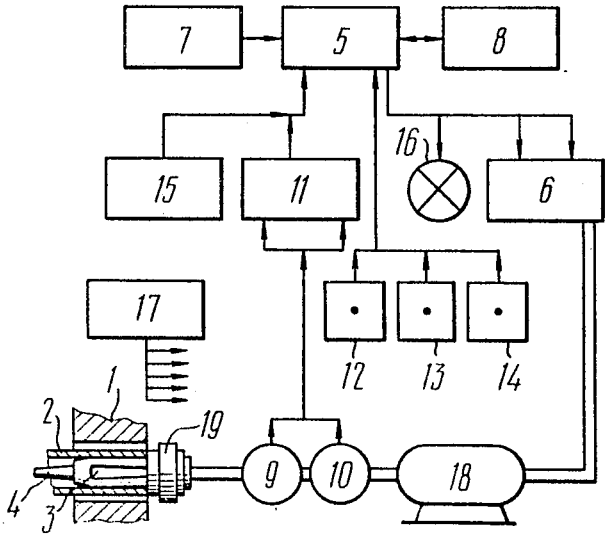
FIG. 2 is a block-unit diagram of the expanding machine capable of performing the disclosed method.

In an expanding machine capable of performing the above-described method there is incorporated a computing device 5 (FIG. 2) receiving and processing the incoming information, and sending control signals to the control unit 6 of the drive. The computing device 5 is operated by a program stored in a permanent storage 7 which also stores all the necessary constant values essential for the computation. The on-line received data and the outcome of the intermediate computation are stored in the internal storage 8. The data representative of the current expanding operation is supplied by devices 9 and 10 which are transducers, respectively, capable of responding to the variable effort and the linear variable, to an analog-to-digital converter 11 which converts the analog signals coming from the transducers 9 and 10 into a digital form and feeds them into the computing device 5. The operator is able to communicate with the computing device 5 through push-buttons STOP 12, START 13 and REVERSE 14. Prior to starting the operation of expanding the tubes of a heat exchanger, the operator feeds the essential initial data into the computing device 5 via the data input device 15 having function and numeric keys. The computing device indicates its readiness by turning on a pilot lamp 16. All the units of the expanding machine are supplied with electric power from a power source 17.

Operating Principle

The expanding machine's operation is commenced by depressing the START button 13. The computing device 5 then feeds a command to the drive control unit 6 which energizes the drive 18 of the expanding tool 19. The operator introduces the tool 19 into the tube 2 to be expanded, whereafter the expanding operation per se is started. Data representative of the variable effort and of the linear variable during the expanding operation along the portions AB, BC and CD (FIG. 1) are fed by the transducers 9 and 10 (FIG. 2) to the computing device 5 which, by appropriately processing these data, determines the position of the point D (FIG. 1), i.e. the optimum value of the variable effort $M_t$, or else of the linear variable $H_{ax}$ for the given rolling joint. Upon having received from either the device 9 or from the device 10 a signal either equal to or in excess of the determined optimum value, i.e. upon the point D having been reached, the computing device 5 sends to the control unit 6 of the drive 18 a reversing-initiating command. The expanding tool 19 is retracted from the tube 2 and is then introduced into the successive tube. The above described cycle is repeated.

The STOP push-button 12 and the REVERSE button 14 are operated to stop and reverse, respectively, the drive 18 in an emergency situation, e.g. at tool breakage, and override the computing device 5.

EXAMPLE 1

Steel tubes 25×2.5 mm are expanded in a steel tube wall.

The yield point of the tube material may vary within a range from 20 to 30 kgf/mm$^2$; the external diameter of the tubes may vary from 24.55 mm to 25.45 mm; and the wall thickness may vary from 2.875 mm to 2.125 mm.

The yield point of the tube wall material is 24 kgf/mm$^2$. The spacing of the openings in the tube wall varies within a 31.5 mm to 32.5 mm range, and the diameter of the openings varies within a 25.50 to 25.64 mm range. The hydraulic testing pressure of the rolling joints of the heat exchanger is set at 140 kgf/cm$^2$.

The expanding operation is conducted in accordance with the abovedescribed method, by determining for each individual rolling joint the position of the point D (FIG. 1), by measuring the variable effort and the linear variable at the portions AB, BC, and CD, and by terminating the expanding operation when point D has been reached.

The optimum value of the variable effort, defining the position of the point D, varies within a range from 3.69 kg.m to 4.60 kg.m, being as it is automatically adapted to the varying dimensions and mechanical properties of the tube material.

For comparison sake, let us state that should the tubes of the present example be expanded according to the hitherto known method, the value $M_t$ would be bound to be the same for every tube and equal to 3.69 kg.m, which would mean that the load-bearing capacity of the majority of the joints would be underemployed.

To demonstrate the advantage of the use of the present invention, there are attached to the present description (FIG. 3) curves depicting the spread of the fluid tightness of the rolling joints, as represented by the value of the hydraulic pressure P breaking the fluid-tightness of the joint at single static application. The X-axis is graduated in values of P in kgf/cm$^2$, and the Y-axis-in the relative frequency "a" of attaining this value P. The curve "b" illustrates the spread of the values P for rolling joints obtained by the hitherto known technique, while the curve "c" is representative of the rolling joints obtained with the use of the present invention.

Figure 3:
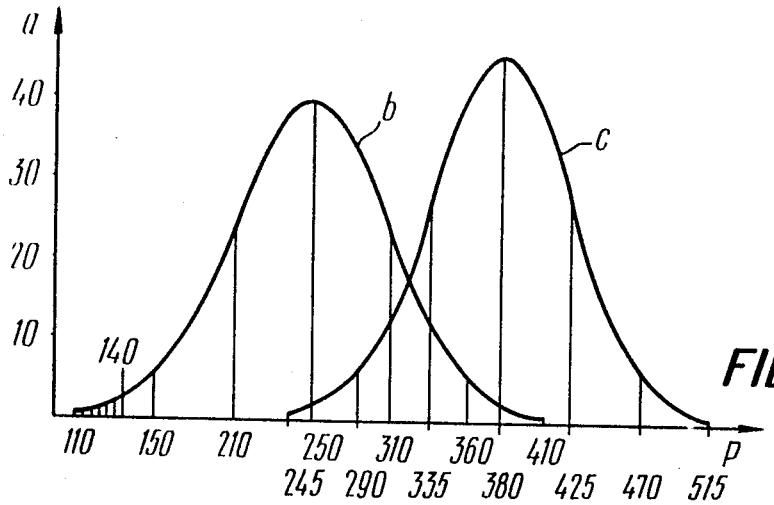
FIG. 3 is a graph showing curves of the distribution or spread of the fluid tightness of rolling joints obtained by the method of the prior art and by the method of the invention from Example 1.

As can be seen from these curves illustrated in FIG. 3, the expanding of the tubes of the present example by the method of the prior art (curve "b") would not provide for the required sealing quality of 140 kgf/cm$^2$ in case of about 0.8% of the rolling joints (the shaded area). The use of the mehod in accordance with the present invention (curve "c") in the present example provides for increasing the mean value of the fluid tightness of rolling joints from 260 kgf/cm$^2$ to 380 kgf/cm$^2$, i.e. by 46%, while the minimum fluid-tightness increases from 110 kgf/cm$^2$ to 245 kgf/cm$^2$, i.e. more than 2.2 times. The tightness spread field has been decreased by 10%.

EXAMPLE 2

Tubes 25×2.5 mm made of steel with a yield point of 42 to 63 kgf/mm$^2$ are expanded in a tube wall of steel with a yield point of 40 kgf/cm$^2$. The rest of the data is the same as in Example 1. In this example the optimum value of the variable effort $M_t$ is within a range from 6.48 kg.m to 8.38 kg.m, while if the tubes had been expanded by the method of the prior art, the effort $M_t$ would have been the same $M_t$=6.48 kg.m for every tube.

Figure 4:
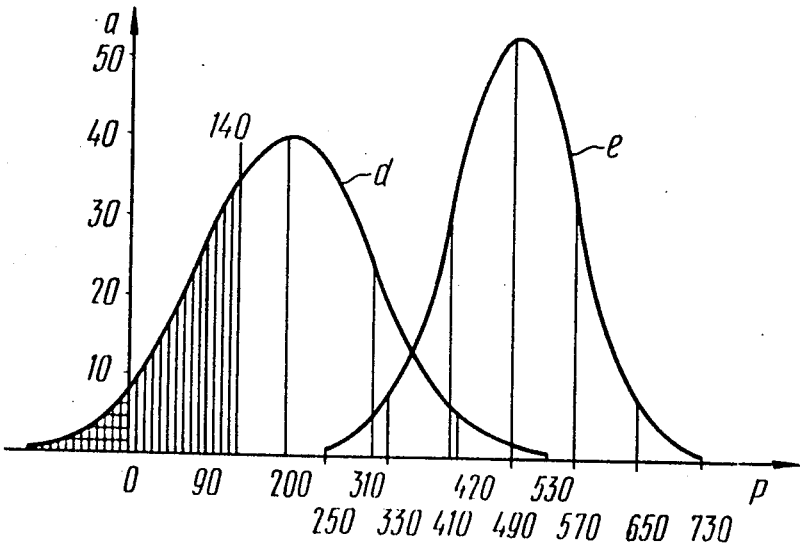
FIG. 4 shows the same as FIG. 3, but with data from Example 2.

The spread curves illustrated in FIG. 4, similar to those described hereinabove in connection with the Example 1 and FIG. 3, show that up to 30% of the rolling joints would not withstand the testing pressure of 140 kgf/cm$^2$, had they been made by the method of the prior art (the shaded area), and in certain cases amounting to 2.5% of the total number of the expanded tubes no rolling joints whatsoever would have been achieved (the shaded area to the left of the Y-axis). The use of the herein disclosed method in connection with Example 2 (curve "e") provides for increasing the mean value of the fluid-tightness from 200 kgf/cm$^2$ to 490 kgf/cm$^2$, i.e. by 145%, with the minimum tightness being 250 kgf/cm$^2$. The tightness spread field has been decreased by 27%.

What is claimed is:

1. A method of expanding tubes in a tube wall, comprising the steps of: acting upon the tube with a roller-type rolling tool to expand the tube, measuring simultaneously a variable effort and a linear displacement variable, as caused by said acting, which variables define the magnitudes of stresses and deformations occurring during expanding, said measuring being conducted successively at three operationwise stages, viz. the stage of elastic deformation of the tube, the stage of plastic deformation of the tube until the moment of the engagement of the external surface thereof with the surface of the opening in the tube wall, and the stage of elastic deformation of the tube wall, and optimizing the control over the expanding operation by the variable effort and the linear displacement variable to obtain maximum strength and fluid-tightness of the assembly of the tube in the tube wall, in accordance with the geometric dimensions and the mechanical properties of the respective materials of the tube and of the tube wall.

2. A method as claimed in claim 1 wherein said displacement variable is axial displacement of said rolling tool.

3. A method as claimed in claim 2 further comprising reversing the displacement of said tool to withdraw the same from the tube following expansion thereof for renewed operation with a further tube and tube wall.

4. A method as claimed in claim 1 wherein the optimization of the control over the expanding operation determines the final position of linear displacement of the rolling tool which causes maximum deformation of the tube.

5. A method as claimed in claim 1 wherein said tool is a rotatable tapered mandrel which is axially advanced into said tube and rotated to produce expansion of the tube, the axial advancement of the mandrel representing the linear displacement variable and the torque applied to the mandrel representing said variable effort.

6. A method as claimed in claim 5 wherein said axial advancement of the mandrel and the torque applied thereto are continuously measured in the course of expansion of the tube to determine maximum strength and fluid-tightness and advancement is then terminated.

* * * * *